United States Patent [19]

Knapstein

[11] 4,376,423

[45] Mar. 15, 1983

[54] METHOD AND APPARATUS FOR SATURATING A LIQUID FUEL WITH A GAS AND AN INTERNAL COMBUSTION ENGINE

[75] Inventor: Paul E. Knapstein, Lake Wales, Fla.

[73] Assignees: William C. Knapstein; Carol A. Knapstein, both of Vero Beach, Fla.

[21] Appl. No.: 271,363

[22] Filed: Jun. 8, 1981

[51] Int. Cl.[3] ..... F02M 43/00

[52] U.S. Cl. ..... 123/1 A; 123/523; 123/533; 123/585; 123/304; 123/3

[58] Field of Search ..... 123/523, 585, 304, 533, 123/531, 1 A, 3, 575

[56] References Cited

U.S. PATENT DOCUMENTS

| | | | |
|---|---|---|---|
| 2,965,085 | 12/1960 | Kahler | 123/1 A X |
| 3,828,736 | 8/1974 | Koch | 123/3 |
| 3,877,450 | 4/1975 | Meeks | 123/1 A X |
| 3,977,365 | 8/1976 | Vierling et al. | 123/1 A |
| 4,011,840 | 3/1977 | Forster | 123/3 |
| 4,068,639 | 1/1978 | Cook | 123/1 A |
| 4,161,160 | 7/1979 | Hicks et al. | 123/1 A |
| 4,167,920 | 9/1979 | Lepera | 123/1 A |
| 4,331,121 | 5/1982 | Stokes | 123/575 |

FOREIGN PATENT DOCUMENTS

| | | | |
|---|---|---|---|
| 897181 | 3/1945 | France | 123/1 A |

*Primary Examiner*—Wendell E. Burns
*Attorney, Agent, or Firm*—William M. Hobby, III

[57] ABSTRACT

An apparatus and a method of saturating liquid fuel with air, oxygen, or another gas for injecting into an internal combustion engine. The internal combustion engine is provided with a gas compressor or pump for compressing air or oxygen, which is directed into a fuel saturator having a dense, porous material or stone therein and having a liquid hydrocarbon fuel being fed therethrough. Compressed gas is fed onto one side of the stone and is forced therethrough for saturation into the liquid fuel, which is then fed into a fuel injection system of an internal combustion engine. Gas that separates from the liquid fuel is trapped and vapor is removed therefrom. The fuel saturator uses a gas saturation stone, which may be hollow in one end for feeding a compressed gas thereinto, while the other side is surrounded with the liquid hydrocarbon fuel. The liquid hydrocarbon fuel may be fed around a spiralling passageway adjacent the stone for a more complete saturation of the fuel.

25 Claims, 2 Drawing Figures

METHOD AND APPARATUS FOR SATURATING A LIQUID FUEL WITH A GAS AND AN INTERNAL COMBUSTION ENGINE

BACKGROUND OF THE INVENTION

The present invention relates to internal combustion engines, and especially to fuel injection type engines in which the liquid fuel has been saturated with a gas for injection into the engine.

In the past, a great variety of internal combustion engine fuel systems have been provided for use on internal combustion engines in vehicles and for other purposes. Typically, a hydrocarbon fueled engine might have a carburetor in which a liquid fuel is vaporized in a fixed or variable venturi as air from the atmosphere is fed through the venturi, drawing liquid vapor into the intake manifold and into the cylinders of the engine. Diesel engines more commonly provide a fuel injection system in which the fuel is injected directly into the combustions chambers under high pressure and does not use a spark to ignite the charge being injected into the cylinder. Typically, air has already been drawn into the cylinder and compressed at the time the fuel is injected thereinto. It is also common to provide a fuel injection system for more conventional spark ignition internal combustion engines which work at a lower combustion chamber pressure in order to improve the efficiency of the engine.

The present invention is directed primarily at internal combustion engines, both diesel and spark ignited engines, which have fuel injection systems and provides for the saturation of the liquid hydrocarbon fuel with oxygen or air under pressure through a fuel saturator. The fuel saturator requires a dense, but slightly porous stone or other material which forces a gas under pressure into the liquid fuel. It has been common in the past to saturate liquids with gases, such as carbon dioxide, to form soda water or to increase the gas content in malt drinks, such as beer. Saturated liquids, however, have to be maintained under pressure until just prior to use. The present invention utilizes a stone similar to the one used by brewers, but which has been enclosed in a casing with a spiralling passageway in order to increase the rate and saturation of the liquid fuel with a gas.

Other prior art type systems include the use of various systems for bubbling air through a liquid fuel in order to vaporize the fuel, as well as a variety of other circuits directed primarily at vaporizing the fuel by the passing of a gas therethrough. These systems do not attempt to saturate the liquid with a gas, but rather to vaporize the liquid in the air, and are used primarily in carburetor type fuel systems. It has also been known to feed gases into a carburetor at the same time the hydrocarbon fuel is being vaporized therein and various fuel additives have been added to fuels to modify the fuel being fed to the fuel system. An advantage of the present invention is that the hydrocarbon liquid fuel can be saturated with a number of gases which can then be used on a fuel injection system without the individual injectors being broken by air or another gas getting into the fuel injectors. That is, most fuel injectors on internal combustion engines will not operate if air gets trapped in the injectors, so that gases cannot normally be fed with a fuel through a fuel injected system of an engine.

SUMMARY OF THE INVENTION

An internal combustion engine is provided having a gas saturator for saturating liquid fuels with a gas such as air or oxygen. The internal combustion engine has a gas saturation means for saturating gas into a liquid fuel. The gas saturation means has a liquid fuel inlet or input and a liquid fuel output, as well as a gas inlet, and includes a container having a dense, porous material such as special types of natural stone. The liquid fuel is fed over one side of the stone, while the gas under pressure is fed to the other. A gas compressor is provided for compressing the gas, and the gas compressor is connected to the gas saturation means gas inlet for directing the gas under pressure to the gas saturation means. Means are provided for directing the liquid fuel saturated with the gas from the gas saturation means into the internal combustion engine combustion chambers. A gas bleed off is provided to capture gas that escapes from the saturated liquid fuel and to feed the gas to a fuel trap for capturing vapor pulled off with the gas.

The method of saturating a liquid fuel with gas in an internal combustion engine is also provided comprising the steps of compressing the gas, applying the compressed gas against one side of a dense, porous material, or stone and passing a liquid fuel under pressure against the other side of the dense, porous material for saturating the liquid with the gas forced through the stone, and injecting the gas saturated liquid fuel into the combustion chambers of the internal combustion engine. Additional steps include trapping gas released from the saturated liquid and removing vapor from the released gas. The fuel saturator includes a dense, porous material mounted in a container and may include a spiralling passageway between the walls of the container and the dense, porous material to direct the liquid fuel passing therethrough in a spiralling pattern to assure that the fuel gets saturated prior to being injected into the combustion chambers of the engine.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figures 1, 2:
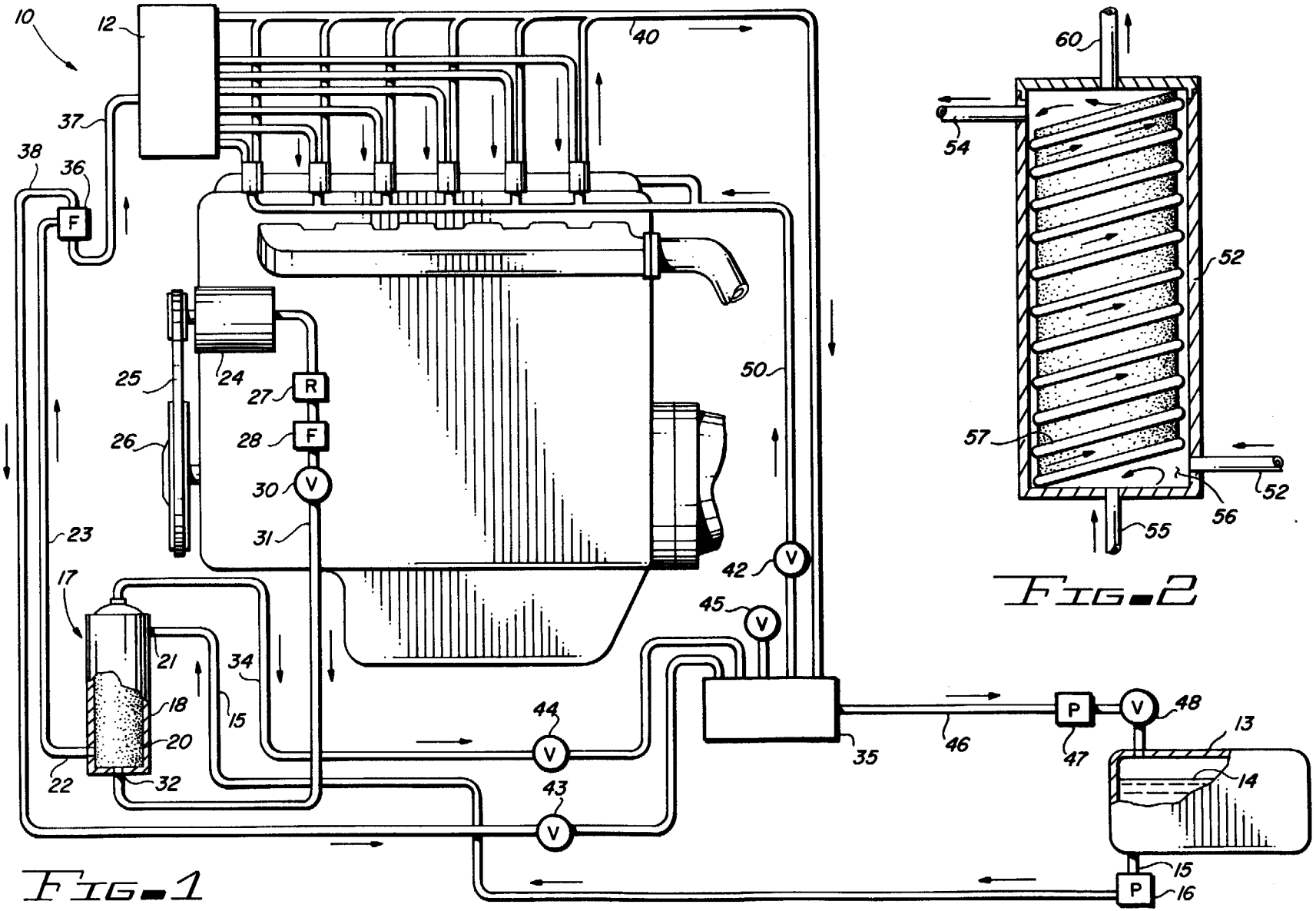
FIG. 1 is a diagrammatic view of a fuel system attached to an internal combustion engine.
FIG. 2 is a sectional view of a fuel saturator for use in accordance with the present invention.

Referring now to the drawings and especially to FIG. 1, an internal combustion engine 10 is illustrated having a plurality of fuel injectors 11 attached thereto and being connected to a fuel injector pump 12. The fuel injectors 11 are the conventional type used on a diesel or spark ignited internal combustion engine, and along with the pump 12, would not have to be changed in adapting the present invention to an existing engine. The engine 10 is operated on a liquid fuel such as a No. 2 diesel fuel or other liquid hydrocarbon fuel, from the tank 13 having the fuel 14 therein. The fuel 14 is fed from the tank 13 through a fuel line 15 through a conventional fuel pump 16 and into the newly added fuel saturator 17. The saturator 17 has a casing 18 and inside the casing is a dense, porous material 20, such as a brewer stone, which is shown in a cylindrical shape, but which is hollow. The fuel is fed through line 15 into an input 21 and into the container 18. The fuel flows into the container around the stone 20 and out of outlet 22 into a fuel line 23. An air pump or air compressor 24 attached to the internal combustion engine 10 may be driven by a belt 25 attached to a pulley 26 connected to the crank shaft of the engine. Air from the atmosphere can be compressed in a compressor 24 and is fed through an air regulator 27 through an air filter 28 and through an air check valve 30, through an air line 31 into fuel saturator 17 inlet 32 and into the inside of the dense, porous material 20. Under pressure, the air is forced through the dense, porous material where it is forced into a liquid fuel therein on the opposite side of the porous material 20 to saturate the liquid fuel with the gas. It should be pointed out at this point, that while air is shown being compressed, oxygen or any other gas could be saturated into the liquid fuel and rather than a compressor 24, a small tank of compressed oxygen could be utilized without departing from the spirit and scope of the invention.

The fuel saturator 17 has an outlet 33 from the top thereof and in line 34 attached thereto for capturing excess gas being forced into the liquid in the fuel saturator 17. This gas is fed through the line 34 into a fuel trap 35, which may include a foam trap for capturing vapor in the gas being removed from the fuel saturator 17. Saturated fuel is fed from the fuel filter 36 through a fuel line 37 to the fuel injection pump 12. The fuel filter 36 also has a gas line 38 connected thereto for removing any additional gas that has escaped from the saturated liquid fuel, which gas is also fed back to the fuel trap 35 where fuel vapor is captured in the fuel trap. The saturated fuel fed through the line 37 into the injector pump is injected into the fuel injectors in a conventional manner, except that an additional fuel bleed off line 40 is connected to each fuel injector and each fuel bleed off line is connected to a fuel bleed off return line 41, which is in turn connected to the fuel trap 35.

An in-line check valve 43 is connected in the vapor return line 38 and a similar check valve 44 is connected in the vapor return line 34. The fuel trap 35 also has a pressure relief valve 45 attached thereto to prevent the build up of excess pressure therein. The fuel trap has an exit liquid fuel line 46 passing through an electric fuel pump 47 and through a check valve 48 back into the fuel tank 13. The fuel trap 35 has a gas or air line 50 connected therefrom through the check valve 42 back to the air inlet for each combustion chamber for utilizing the gas being returned from the fuel trap 35, which gas may still have a small amount of vapor therein. The saturated fuel being fed to the combustion chambers improves combustion and can enhance the combustion process by the use of gases other than air, which would further enhance the combustion process.

The method of the present invention provides for feeding a liquid fuel to the fuel saturator 17, compressing air or another gas in the compressor 24 and feeding it into the fuel saturator 17 on one side of the dense, porous stone 20, while the fuel is being fed on the other side thereof. The liquid fuel is saturated with the gas and then injected into the engine, and might also include the steps of bleeding off excess gas release from the saturated fuel and trapping the vapor from the bled off gas in a fuel vapor trap.

FIG. 2 shows a modified embodiment of the fuel saturator 51 having a casing 52 and a fuel inlet 53 for feeding a liquid fuel thereinto. A fuel outlet 54 feeds fuel saturated with gas from the fuel saturator 51. The gas is fed through a gas inlet 55 into a hollow space 56 located in a dense, porous material, such as a brewer stone, which is shaped in a cylindrical shape with a limited amount of space between the stone 57 and the walls 52 of the fuel saturator. The stone is then wrapped with a spiralling guide 57 which may be adhesively attached to the stone or to the interior walls of the casing 52 and which may be of a rubber or polymer material. This forces the fuel from the fuel inlet 53 around the stone in a spiralling pattern to assure a more complete saturation of the liquid fuel with the gas being fed in the inlet 55. An outlet 60 allows a bleed off of excess gas from the liquid fuel which is fed back to the vapor trap 35 of FIG. 1. It should be clear that a method and apparatus for saturating a liquid hydrocarbon fuel with various gases has been provided for use in fuel injection engines.

The first tests have utilized a brewer stone as a dense, porous material and this stone is a naturally occurring stone, but it should be clear that other dense, porous materials are also contemplated as being within the scope of the present invention. Accordingly, the present invention is not to be construed as limited to the forms shown, which are considered to be illustrative rather than restrictive.

I claim:

1. An internal combustion engine having a gas saturator for saturating liquid fuel with a gas, comprising in combination:

an internal combustion engine;

a gas saturation means for saturating gas into a liquid fuel and having a liquid fuel inlet and a liquid fuel outlet and a gas inlet;

gas compressor means for compressing a gas, said gas compressor means being connected to said gas saturation means gas inlet for directing gas under pressure into said gas saturation means; and means for directing a liquid fuel saturated with gas from said gas saturation means into said internal combustion engine combustion chambers whereby a liquid fuel saturated with a gas is burned in an internal combustion engine.

2. An apparatus in accordance with claim 1, in which the gas saturation means includes a dense, porous material for feeding a liquid fuel on one side thereof and a compressed gas on the other side thereof for saturating said liquid fuel with said gas.

3. An apparatus in accordance with claim 2, in which said gas saturation means has a gas bleed off for bleeding off excess gas from said gas saturator.

4. An apparatus in accordance with claim 3, in which said gas compressor means includes an air pump connected to an air regulator to said fuel saturator.

5. An apparatus in accordance with claim 3, in which said gas bleed off is fed through to a fuel trap for capturing vapor in said gas being bled from said fuel saturator.

6. An apparatus in accordance with claim 5, in which said bleed off line includes an in-line check valve therein to prevent gas under pressure from being fed from said fuel trap back to said fuel saturator.

7. An apparatus in accordance with claim 6, in which said fuel trap includes a foamed polymer material therein for capturing liquid fuel therein and a fuel line connecting said fuel trap to said fuel tank.

8. An apparatus in accordance with claim 7, in which said line connecting said fuel trap to said fuel tank has a fuel pump and a check valve located therein.

9. An apparatus in accordance with claim 8, in which liquid fuel saturated with gas being fed from said fuel saturator passes through a fuel filter having a gas bleed off line attached thereto for bleeding off gas to said fuel trap.

10. An apparatus in accordance with claim 9, in which said bleed off line from said fuel filter has a check valve therein.

11. The apparatus in accordance with claim 10, in which said fuel from said fuel filter is fed into a fuel injector pump for injection into the engine combustion chambers and each fuel injector line has a fuel bleed off return line connected to said fuel trap.

12. The apparatus in accordance with claim 5, in which said fuel trap has a pressure relief valve attached thereto.

13. The apparatus in accordance with claim 12, in which said fuel trap has a line connected therefrom into the intake air line of said internal combustion engine.

14. The apparatus in accordance with claim 13, in which said gas line from said fuel trap to said intake air line has a check valve therein.

15. An apparatus in accordance with claim 1, in which said fuel saturator has a cylindrical dense, porous material therein having a spiralling fuel guide formed therearound for directing liquid fuel around said dense, porous material in a spiralling passageway.

16. An apparatus in accordance with claim 1, in which said gas compressor means includes an air pump connected to an air regulator to said fuel saturator.

17. An apparatus in accordance with claim 16, in which said gas compressor means is an air pump connected to said fuel saturator through an air filter and an air check valve.

18. In an internal combustion engine, a method for saturating liquid fuel with gas, comprising the steps of:

compressing a gas;

applying said compressed gas against one side of a dense, porous material;

passing a liquid fuel under pressure against the other side of said dense, porous material for saturating said liquid fuel with gas through said dense, porous material; and injecting said gas saturated liquid fuel into the combustion chamber of an internal combustion engine.

19. The method in accordance with claim 18, including the step of trapping gas released from said saturated liquid fuel.

20. The method in accordance with claim 19, including the step of trapping vapor from said gas released from said saturated liquid in a vapor trap.

21. The method in accordance with claim 20, including feeding released gas passing through said vapor trap back to the engine air intake.

22. The method in accordance with claim 18, in which the step of passing a liquid fuel under pressure against the other side of a dense, porous material includes passing the liquid fuel adjacent said stone in a spiralling pattern around said dense, porous material.

23. The method in accordance with claim 22, in which the step of compressing a gas includes compressing atmospheric air in an air compressor.

24. The method in accordance with claim 18, in which the step of compressing includes storing the compressed gas in a cylinder.

25. The method in accordance with claim 24, in which the step of compressing gas includes compressing oxygen into a compressed oxygen cylinder.

* * * * *